United States Patent [19]

Pfarrwaller

[11] Patent Number: 4,534,386

[45] Date of Patent: Aug. 13, 1985

[54] TENSIONING BEAM ASSEMBLY FOR A WEAVING MACHINE

[75] Inventor: Erwin Pfarrwaller, Winterthur, Switzerland

[73] Assignee: Sulzer Brothers Limited, Winterthur, Switzerland

[21] Appl. No.: 531,703

[22] Filed: Sep. 13, 1983

[30] Foreign Application Priority Data

Oct. 26, 1982 [EP] European Pat. Off. ..... 82810448.9

[51] Int. Cl.[3] ..... D03D 49/22

[52] U.S. Cl. ..... 139/114; 139/1 R; 139/97

[58] Field of Search ..... 139/1 R, 114, 115, 97, 139/101, 103, 110, 145

[56] References Cited

U.S. PATENT DOCUMENTS

| | | | |
|---|---|---|---|
| 3,101,747 | 8/1963 | Hindle | 139/114 X |
| 3,186,441 | 6/1965 | Engels | 139/114 |
| 3,871,419 | 3/1925 | Pfarrwaller | 139/114 |
| 4,240,471 | 12/1980 | Rotrekl et al. | 139/114 |
| 4,262,706 | 4/1981 | Popp et al. | 139/114 X |

FOREIGN PATENT DOCUMENTS

| | | | |
|---|---|---|---|
| T63601 | 7/1976 | Czechoslovakia . | |
| 629549 | 4/1982 | Switzerland | 139/110 |
| 2003198 | 3/1979 | United Kingdom | 139/145 |

*Primary Examiner*—James Kee Chi

*Attorney, Agent, or Firm*—Kenyon & Kenyon

[57] ABSTRACT

The tensioning beam assembly has a tensioning beam and/or support beam mounted in step bearings located across the width of the weaving machine. Sagging of the tensioning element is eliminated and reduced diameter tensioning elements and support beams can be used.

The tensioning element may be formed as a solid shaft which is rotatably mounted in individual step bearings on the support beam or fixedly mounted by connecting pieces to the support beam. In one embodiment, the tensioning element is in the form of a plate which is secured directly to the support beam and which has a curved outer end over which the warp threads pass. In still another embodiment, the tensioning element is in the form of a U-shaped plastic strip which is mounted about a projection extending along the support beam.

12 Claims, 15 Drawing Figures

Fig. 3
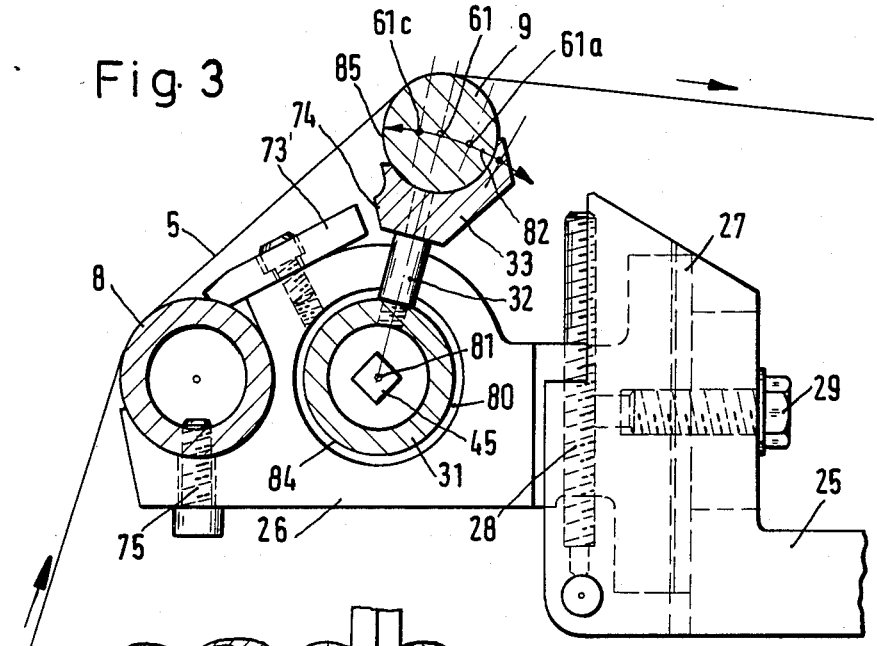
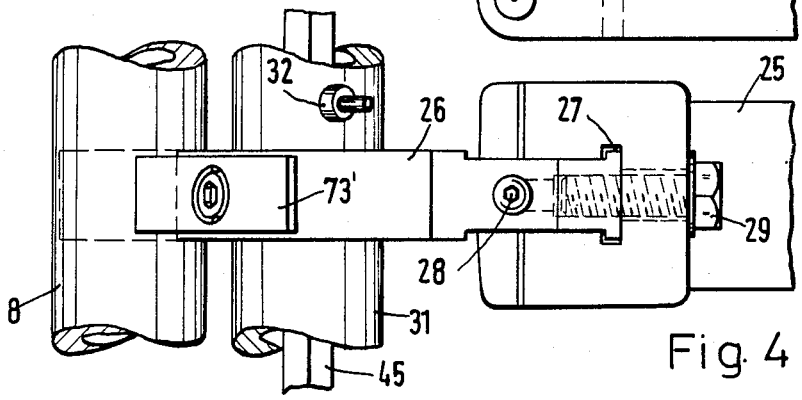
Fig. 4
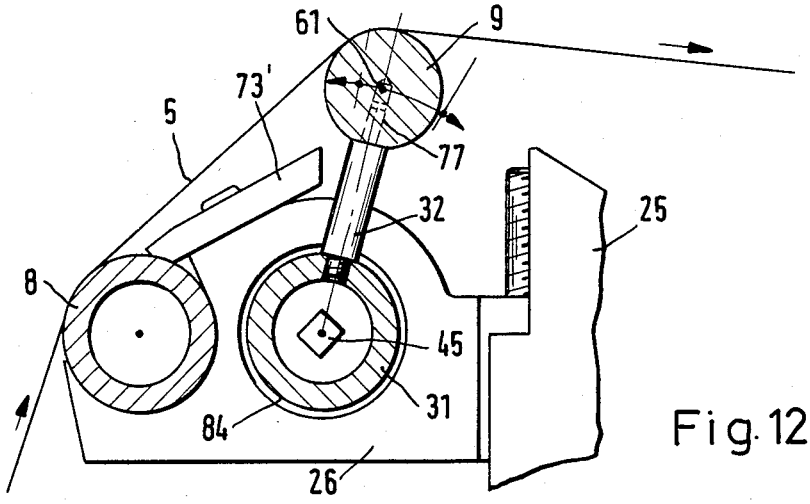
Fig. 12

Fig.8
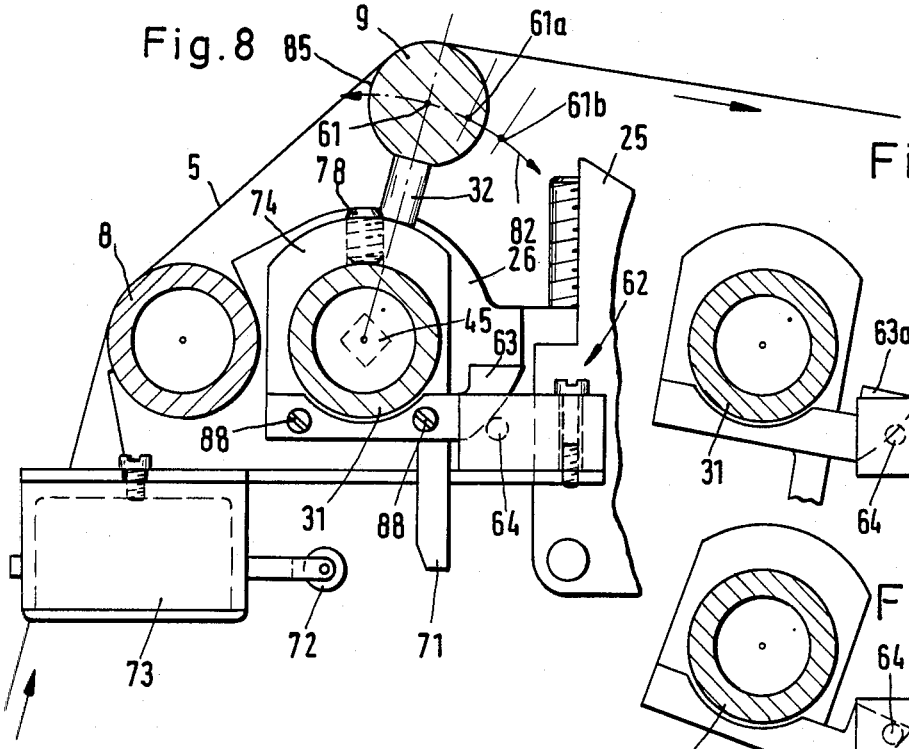
Fig.10
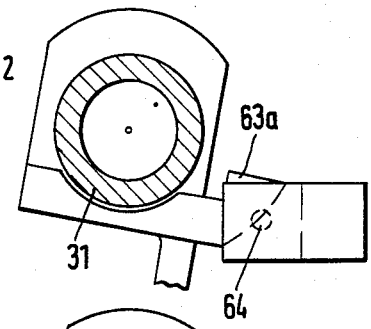
Fig.11
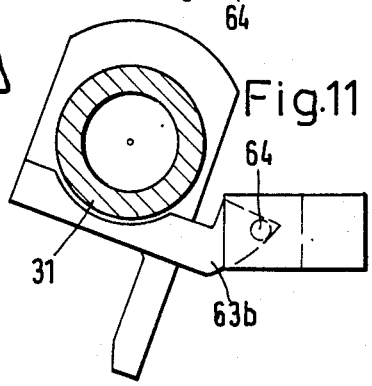
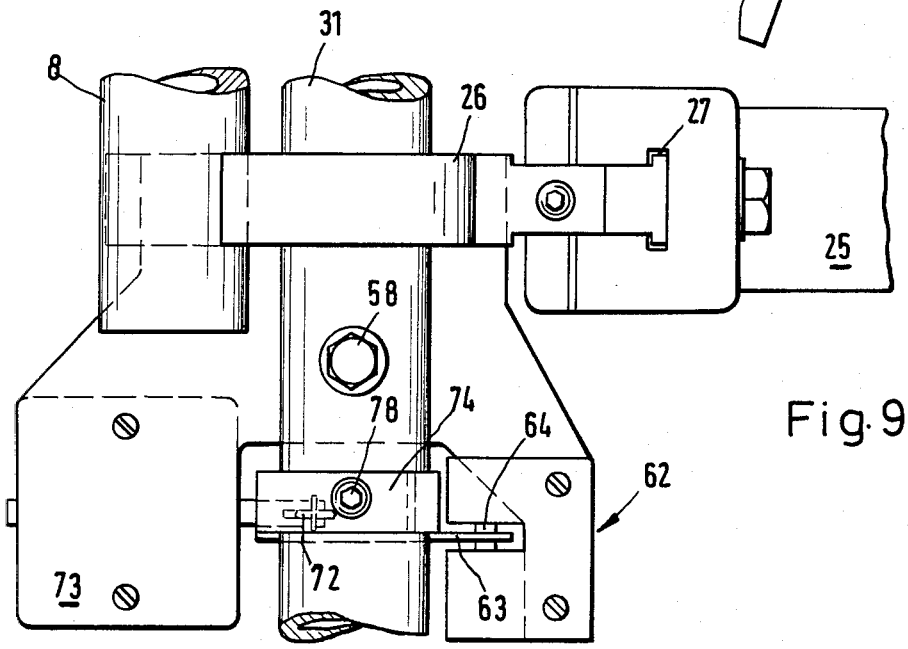
Fig.9

Fig. 13
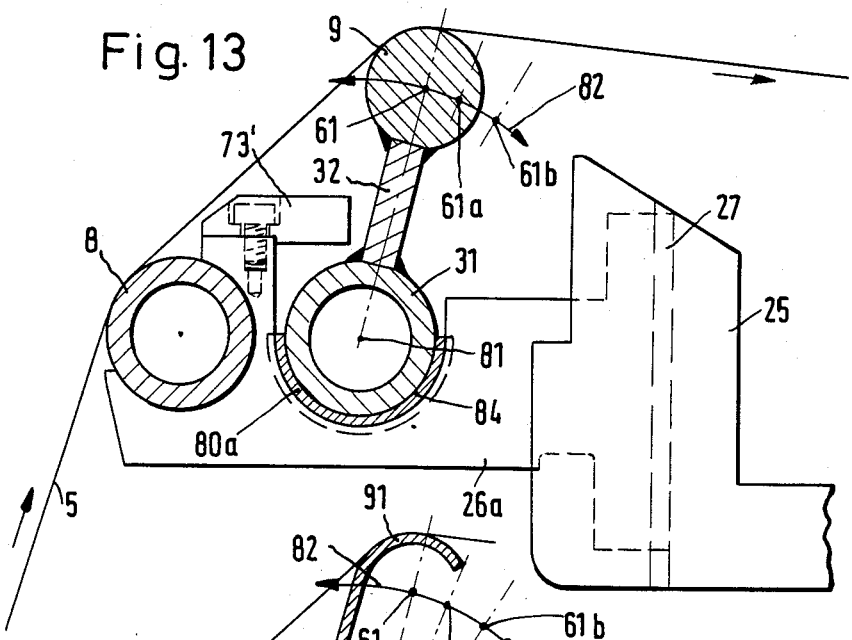
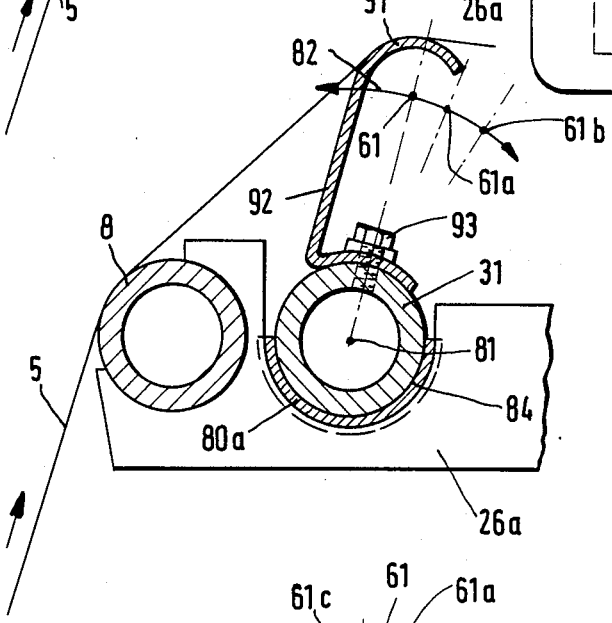
Fig. 14
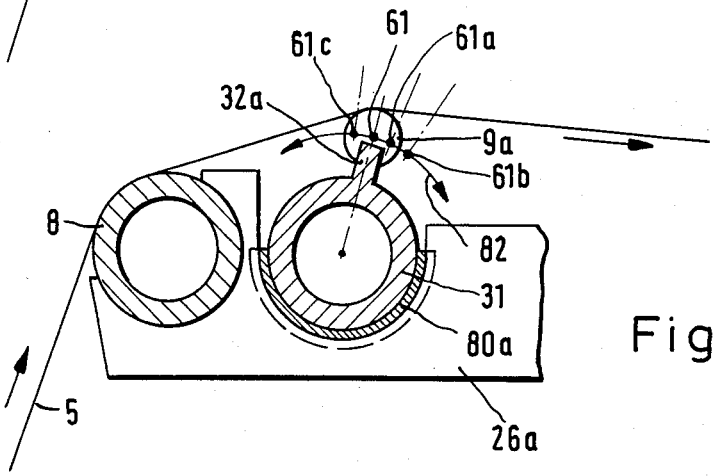
Fig. 15

TENSIONING BEAM ASSEMBLY FOR A WEAVING MACHINE

This invention relates to a tensioning beam assembly for a weaving machine.

Heretofore, weaving machines have been provided with various types of tensioning beam assemblies in order to tension the warp yarns being processed into fabric. For example, Swiss Pat. No. 476,137 describes a tensioning beam assembly wherein a tensioning beam and a support beam are mounted at the ends in bearings. Thus, if the weaving width is large, it has been necessary to make the tensioning beam of a large diameter as otherwise, the beam might sag too readily under the tension of the warp threads. As a result, a relatively large mass must be swung back and forth during weaving.

Accordingly, it is an object of the invention to provide a simplified tensioning beam assembly which does not require tensioning beams of large diameter.

It is another object of the invention to provide a tensioning beam assembly of limited mass.

Briefly, the invention provides a weaving machine which has a frame of predetermined width with a support beam which is mounted across the weaving width of the frame on a longitudinal axis, a spring biased tensioning element which is mounted on the beam for pivoting about the axis of the beam under the bias of warp threads within the weaving width and means supporting the beam intermediately of the weaving width of the frame. As a result, the support beam may be of relatively small size and of relatively low weight even for a relatively wide weaving width. In addition, sagging of the beam under the tension of the warp threads can be avoided. Hence, fabric faults due to a flexed support beam will not occur.

As a rule, the tensioning element is carried by the support beam. Consequently, it is advantageous to provide both the tensioning element and the support beam with the intermediate supports.

Because of the smaller mass, the support beam is able, at high speed of the weaving machine, to more exactly follow the length variations of the warp threads resulting, for example from the movement of the heddles of the machine and the throw of the reed of the machine. Hence, the warp threads can be kept under constant tension during operation.

Further, the tensioning beam assembly permits the weaving machine to be operated more easily from the warp side. This is because the tensioning elements and support beams of large diameter and weight are avoided. Furthermore, an operator can more easily reach over the tensioning element and support beam into the warp threads, for example, to remedy any warp thread ruptures.

In one embodiment, the tensioning element may be made as a solid shaft or beam which is independently rotatable, for example in individually spaced apart step bearings, while being mounted on the support beam.

In another embodiment, the tensioning element may be in the form of a solid beam which is fixed to the support beam via a plurality of connecting pieces.

In still another embodiment, the tensioning element may be directly mounted on the support beam. In such a case, the tensioning element may be in the form of a plate which has a curved outer end. Also, the tensioning element may be in the form of an arcuately bent strip which is secured to a longitudinally disposed projection on the support beam.

The means for supporting the beam may be in the form of a plurality of longitudinally spaced step bearings which are disposed across the weaving width and which are secured to the machine frame.

In order to provide for tensioning of the tensioning element, a tensioning device is mounted on the machine frame and connected, for example, via a rod which passes into the support beam and is secured at one end to the support beam. In addition, the tensioning device includes means for turning the rod for tensioning of the beam and tensioning element against the bias of the warp threads on the tensioning element.

In addition, a drive motor is provided for driving a warp beam mounted on the machine frame and a warp release control device is provided with means for sensing a given position of the tensioning element in order to emit a signal to the drive motor in response to the tensioning element occupying this position so as to regulate the speed of the motor and thus the speed of the warp threads being delivered to the weaving machine. Thus, depending upon the position of the tensioning element, the speed of warp let-off can be regulated to some extent.

These and other objects and advantages of the invention will become more apparent from the following detailed description taken in conjunction with the accompanying drawings wherein:

FIG. 3 illustrates a cross-sectional view of a tensioning beam assembly in accordance with the invention;

FIG. 4 illustrates a plan view of the tensioning beam assembly of FIG. 3;

FIG. 8 illustrates a side view of a warp release control device in accordance with the invention;

FIG. 9 illustrates a top view of the warp release control device of FIG. 8;

FIG. 10 illustrates one of several positions of the warp release control device of FIG. 8;

FIG. 11 illustrates a further position of the warp release control device of FIG. 8;

FIG. 12 illustrates a modified tension beam assembly in accordance with the invention;

FIG. 13 illustrates a further modified tensioning beam assembly having a tensioning element integrally formed with a support beam in accordance with the invention;

FIG. 14 illustrates a modified tensioning beam assembly employing a tensioning element formed of a plate in accordance with the invention; and FIG. 15 illustrates a further modified tensioning beam assembly employing an arcuately bent strip for the tensioning element in accordance with the invention.

Figure 1:
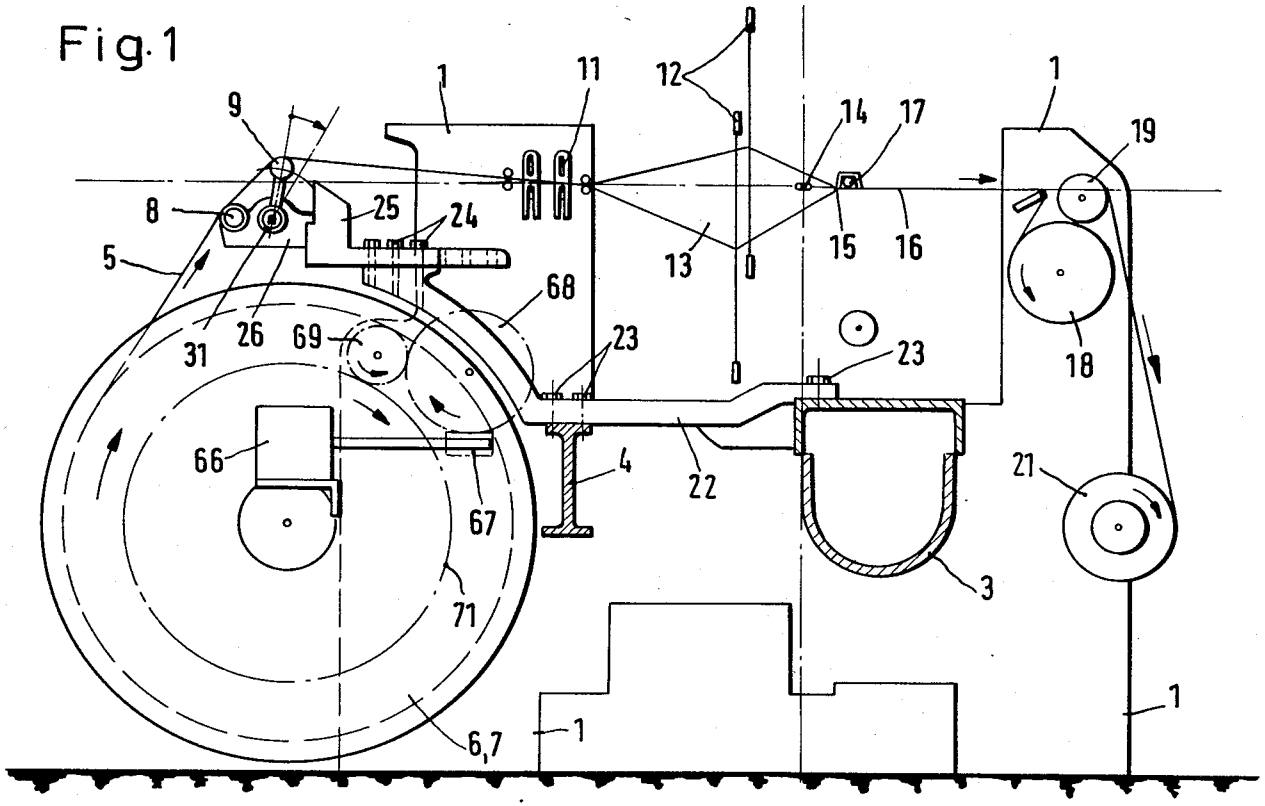
FIG. 1 illustrates a part sectional side view of a weaving machine constructed in accordance with the invention.

Referring to FIG. 1, the weaving machine has a frame formed of two side frames 1, 2 which are connected together by a main girder 3 and a supplementary girder 4. The frame carries a two-part warp beam 6, 7 in the side frames 1, 2 so as to deliver a plurality of warp threads 5 across the weaving width B (see FIG. 2) of the frame. In addition, a tensioning beam assembly is mounted on the frame and includes a guide beam 8 and a tensioning element 9 over which the warp threads 5 are guided to a warp stop motion 11 into a plurality of heddles 12 which are actuated to form a shed 13 of the warp threads 5. As indicated, a weft thread 14 can be picked into the shed 13 at a forward end and can be beaten up at a point 15 via a reed (not shown) in order to form a fabric 16.

As shown in FIG. 1, the produced fabric 16 runs over a temple 17, a cloth draw-off roller 18 and a guide roller 19 onto a cloth beam 21.

The machine frame is also provided with a plurality of supports 22 which are bolted onto the girders 3, 4 via suitable bolts 23.

Referring to FIG. 3, the tensioning beam assembly includes a hollow support beam 31 which is mounted across the weaving width of the machine frame on a longitudinal axis 81 as well as the tensioning element 9 which is mounted on the beam 31 for pivoting about the axis 81 of the beam 31 under the bias of the warp threads 5. In addition, means are provided for supporting at least one of the beam 31 and tensioning element 9 intermediately of the weaving width B of the machine frame. As illustrated, this means includes a plurality of spaced apart step bearings 26 which rotatably mount the beam 31 therein.

Figure 2:
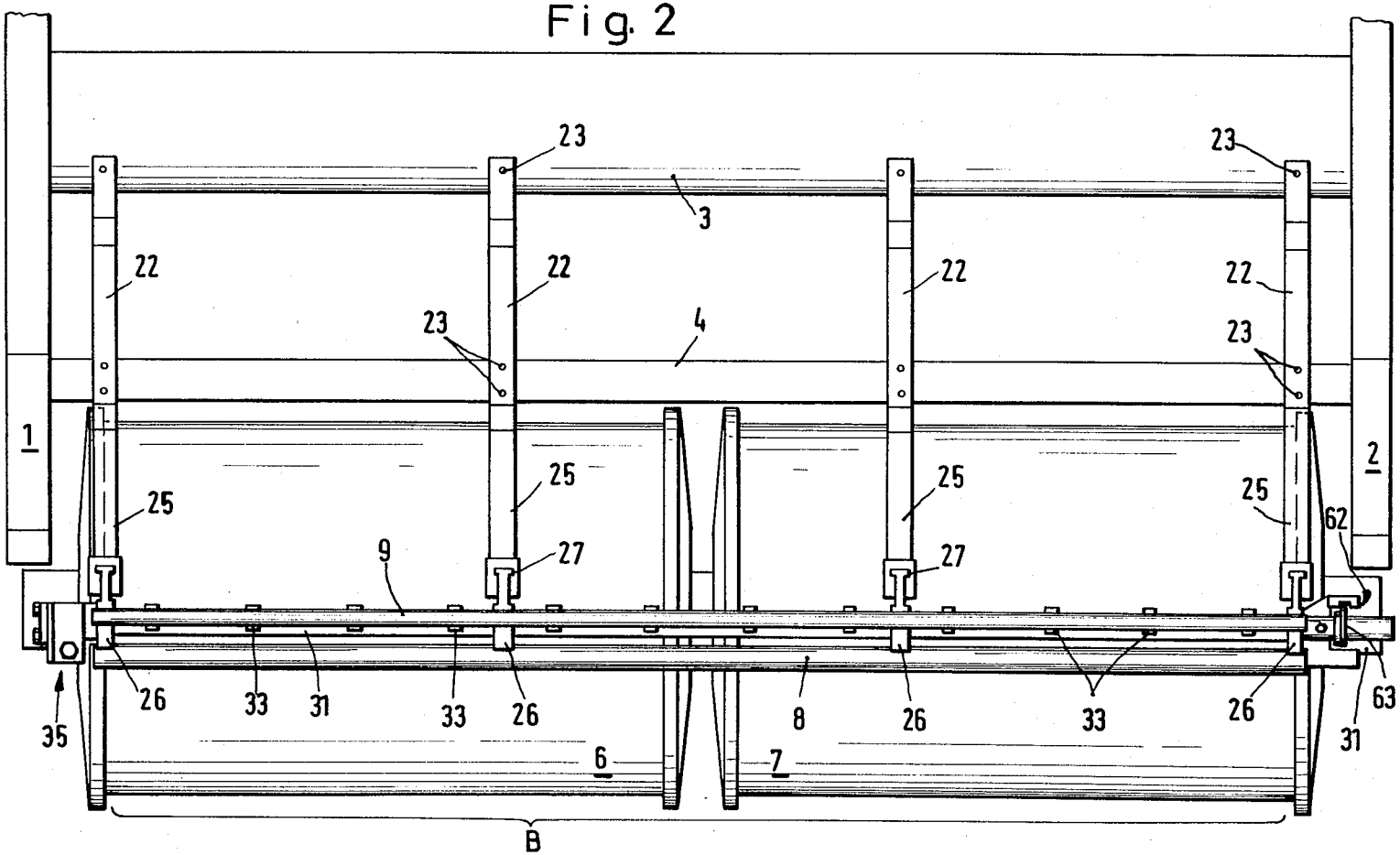
FIG. 2 illustrates a plan view of the warp side of the weaving machine of FIG. 1.

Referring to FIGS. 3 and 4, each step bearing 26 rotatably supports the hollow shaft 31 about the circumferential periphery 84 of the shaft 31 via a bushing 80. Each bearing 26 is held in an arm 25 via a T-shaped guide 27 and is adjustably mounted with respect to height via a set screw 28. In addition, a lock screw 29 is provided to secure the step bearing 26 in place on the arm 25. As shown in FIGS. 1 and 2, each arm 25 is, in turn, secured via bolts 24 to a support 22. As also indicated in FIG. 1, each arm 25 is provided with a plurality of openings so that the arm 25 can be adjusted on the support 22 horizontally.

Further, as shown in FIG. 3, a means for supporting the tensioning element 9 at intermediate points on the support beam 31 includes a plurality of step bearings 33 which rotatably receive the tensioning element 9 and a plurality of connecting pieces 32 which secure the step bearings 33 to the beam 31. As indicated, each step bearing 33 rotatably supports the tensioning element 9 at the periphery 85 of the element 9 about an axis 61 of the element 9 as well as being pivotally mounted about the axis 81 of the beam 31 in the direction indicated by the arrow 82. Each connecting piece 32 is threaded into a step bearing 33 as well as into the hollow shaft 31.

Figure 5:
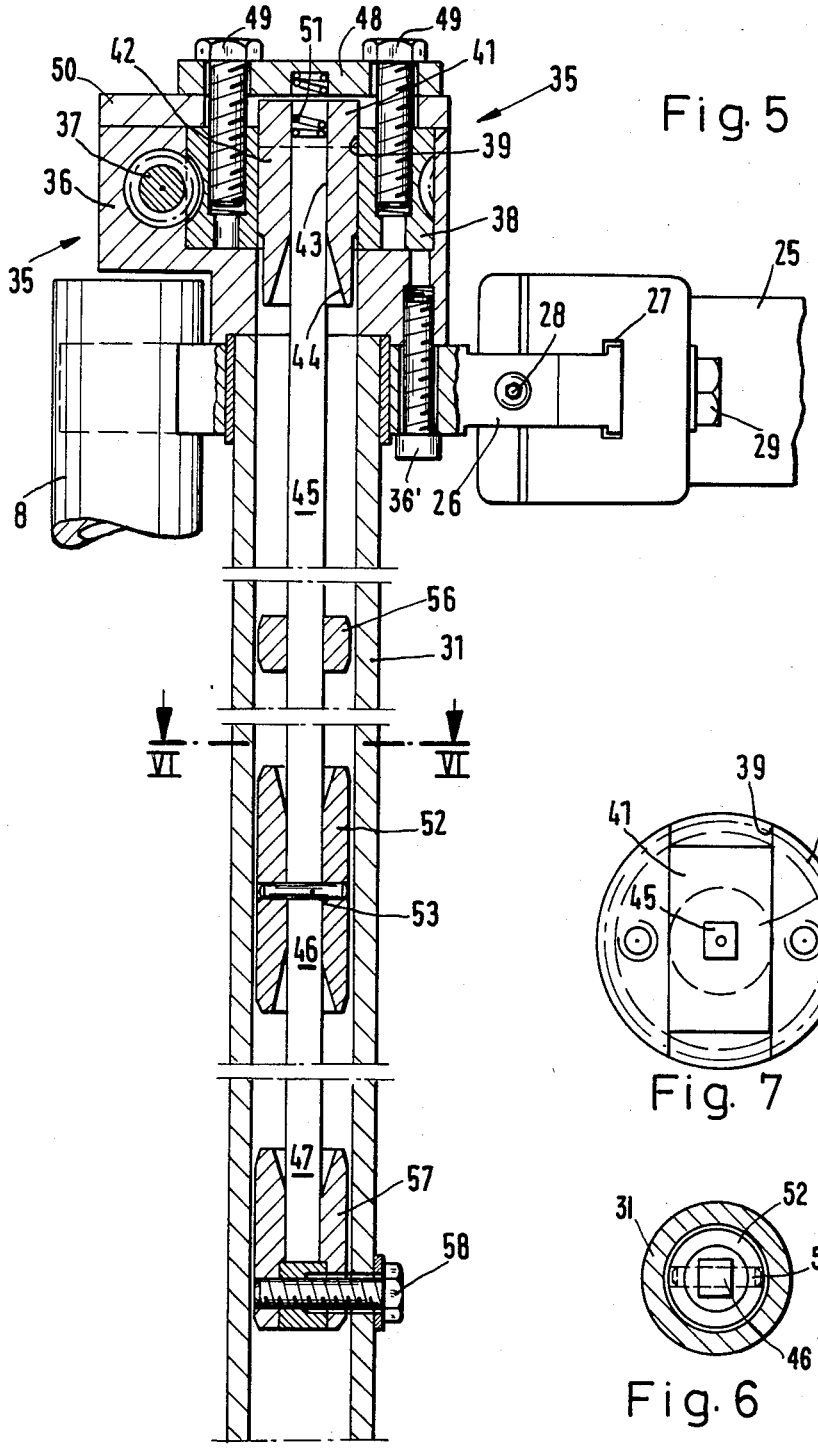
FIG. 5 illustrates a cross-sectional view of a tensioning device for a support beam in accordance with the invention.
Figure 7:
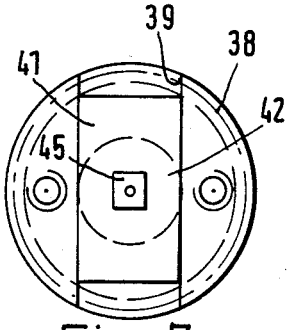
FIG. 7 illustrates a detailed view of a component of the tensioning device in accordance with the invention.
Figure 6:
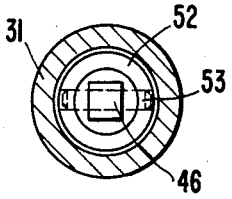
FIG. 6 illustrates a view taken on line VI—VI of FIG. 5.

Referring to FIG. 2, the support beam 31 is rotatably mounted at the ends in step bearings 26 in a manner as described above. In addition, a tensioning device 35 is mounted on the side frame 1 and connected to the beam 31 for turning the beam 31 and tensioning element 9 against the bias of the warp threads 5 on the tensioning element 9. As shown in FIG. 5, the tensioning device 35 includes a shaped part 36 which is connected with the machine side frame 1 via bolts 36' and in which the worm 37 is mounted. The worm 37, in turn, engages a worm gear 38 which is rotatably mounted within the shaped part 36. The gear 38 includes a slot 39 (see FIG. 7) in which a rectangularly shaped shoulder 41 of a sleeve 42 is guided. The sleeve 42 has a square bore 43 with a conical end 44 in which a torsion spring rod, for example, consisting of three sections 45, 46, 47 is mounted. The torsion rod 45, 46, 47 extends into the shaft 31 which is hollow and is secured to the shaft 31 at the end located within the shaft 31. In this regard, the end section 47 of the rod carries a sleeve 57 which is fastened to the support beam 31 via a bolt 58.

In addition, a compression spring 51 is located within the sleeve 42 against the outer end of the torsion rod 45–47 and abuts against a cover plate 48 which is secured to the worm gear 38 via bolts 49. This spring 51 serves to bias the torsion rod 45–47 in a direction into the support beam 31. As indicated, the sections 45, 46, 47 of the torsion rod are connected together in coaxial alignment in a non-rotational manner via couplings such as coupling sleeves 52. Each of these sleeves 52 contains a pin 53 which secures against axial displacement. Further, centering rings 56 are disposed at intervals along the torsion rod sections 45–47 for centering purposes. Such rings may be made, for example, of plastic.

As shown in FIG. 5, a plate 50 is mounted between the cover 48 and the shaped part 36 to serve as a spacer.

The torsion rod 45–47 can be pre-tensioned by means of the worm drive 37, 38. In this respect, the rectangular shaped shoulder 41 of the sleeve 42 is turned by the worm gear 38 so that the sleeve 42 and the first torsion rod section 45 is turned. This, in turn, causes the remaining sections 46, 47 of the rod to turn with the support beam 31 following via the bolt 58. In the event that the support beam 31 is under the bias of the warp threads 5 (see FIG. 3), then the torsion rod 45–47 will twist relative to the support beam 31 and be set under tension.

By changing the degree of twist in the torsion rod 45–47, the tensioning beam 9 may be made to pivot about the axis 81 (see FIG. 3) a more or less amount so as to maintain the warp threads 5 under tension. As indicated in FIG. 3, during operation, the filled diameter of the warp beam 6, 7 gradually decreases. Hence, the axis 61 of the tensioning element 9 is gradually shifted to the right, as viewed, into a position **61*a*** under substantially constant warp tension.

Referring to FIG. 2, the weaving machine is also provided with a warp release control device 62. This control device 62 cooperates with an electric drive motor 66 (see FIG. 1) which drives the warp beam 6, 7 via a worm 67, a worm gear 68, a gear wheel 69 and a gear wheel 71 secured on an axle of the warp beam 6, 7.

Referring to FIGS. 8 and 9, the warp release control device 62 has means for sensing a given position of the tensioning element 9 and for emitting a signal to the drive motor 66 in response to the tensioning element 9 occupying this position in order to regulate the speed of the motor 66. For example, the means for sensing the position of the tensioning element includes a control lug 63 which is carried on the support beam 31 by means of a sleeve 74. As shown, the sleeve 74 is fastened to the support beam 31 by a set screw 78 while the lug 63 is secured to the sleeve 74 by a pair of screws 88. In addition, a photoelectric eye 64 is mounted in a fixed position, for example on an arm 25 in the path of the control lug 63. When the parts are in the position shown in FIG. 8, the lug 63 is outside the light beam of the photoelectric eye 64. If the axis of the tensioning element 9 moves into the position **61*a*, the lug 63 is pivoted into the position 63*a* shown in FIG. 10 in which the light beam of the photoelectric eye 64 is shielded approximately by one half. At this time, a signal is emitted to the drive motor 66 so as to accelerate the warp beam 6, 7. When the axis 61 of the tensioning element 9** assumes the position 61*b* (FIG. 8), the lug 63 occupies a position 63*b* as shown in FIG. 11. At this time, the light beam of the photoelectric eye 64 is completely shielded and the drive motor 68 is caused to run at full speed.

Referring to FIG. 8, the sleeve 74 also carries a finger 71 which cooperates with a roller 72 mounted on a switch 73. Should the pivoting of the axis 61 of the tensioning element 9 exceed the position 61*b*, for example, due to a malfunction, the finger 71 would actuate the switch 73 to stop the machine.

Referring to FIG. 3, one or more of the step bearings 26 for the support beam 31 may be provided with a fixed stop 73′ so as to define a rear terminal position of the tensioning element 9. As shown, the stop 73′ is fastened via a bolt to the step bearing 26 and faces a shoulder 74 on a step bearing 33 upon which the tensioning element 9 is mounted. Abutment of the shoulder 74 against the stop 73′ defines the terminal position 61*c* of the axis 61 of the tensioning element 9.

As can be seen from FIG. 3, the tensioning element 9 is rotatably mounted in the step bearings 33 while the guide beam 8 is secured against rotation by a screw 75. Thus, the warp threads 5 slide over the guide beam 8 while setting the tensioning element 9 into rotation about the axis 61.

Alternatively, instead of employing a plurality of step bearings 33 across the weaving width B, a longitudinally elongated step bearing may extend over the entire weaving width B to receive the tensioning element 9. Such a step bearing may have the same cross-section as the step bearings 33 indicated in FIG. 3.

Referring to FIG. 12, wherein like reference characters indicate like parts as above, the tensioning beam assembly may be alternatively constructed so that each connecting piece 32 extends via a cylindrical end 77 into the tensioning element 9 while the opposite ends are threadably mounted in the support beam 31. In this embodiment, the tensioning element 9 cannot follow the warp threads 5 as they move across the element 9 since the element 9 is secured against rotation. In addition, each connecting piece 32 may be aligned to strike against a stop 73′ in the terminal position of the tensioning element 9.

Referring to FIG. 13, wherein like reference characters indicate like parts as above, the support beam 31 may alternatively be mounted in open step bearings 26 with the interposition of open bushings 80*a*. In addition, the support beam 31, connecting pieces 32 and tensioning element 9 may be welded together to form a unit. Alternatively, the support beam 31, connecting pieces 32 and tensioning element 9 may be formed together in one piece.

Referring to FIG. 14, wherein like reference characters indicate like parts as above, the tensioning element may be in the form of a plate 92 which is secured directly to the support beam 31 via bolts 93. Further, the plate 92 may be provided with a curved end 91 which extends over the entire weaving width B. Alternatively, the tensioning element may have a different cross-section, for example, one of umbrella shape.

Referring to FIG. 15, wherein like reference characters indicate like parts as above, the support beam 31 may be provided with a longituidnally disposed projection 32*a* across the weaving width while the tensioning element is in the form of an arcuately bent strip, for example a U-shaped strip 9*a*, which is secured to the projection 32*a* across the weaving width. The strip 9*a* may also be made of a plastic material or other suitable material to act as a tensioning element for the warp threads 5.

Of note, the support beam 31 may also be mounted in a continuous bearing trough which extends across the entire weaving width B of the machine.

In all of the above described embodiments, the tensioning element and/or the support beam are mounted or supported by a continuous step bearing or by a plurality of individual step bearings which are distributed over the weaving width B. As a rule, for a circular cross-section of the tensioning element and support beam, a suspension engaging on the periphery of each would be provided for these parts. However, if desired, the support beam may have a cross-section other than circular, for example a semi-circular cross-section.

The invention thus provides a tensioning beam assembly wherein the support beam and tensioning element may be made of relatively small diameters or cross-sections and of, thus, relatively small mass. Hence, only relatively small masses are in motion during a swinging back and forth of the parts during weaving.

The invention further provides a tensioning beam assembly wherein the tensioning element and support beam are supported at a number of points across the weaving width so that flexing of the tensioning element during operation of the weaving machine can be prevented. Still further, the invention provides a tensioning beam assembly which occupies a relatively small space so that the weaving machine is more accessable from the warp side.

What is claimed is:

1. In a weaving machine having a frame of predetermined weaving width, the combination of a rotatable support beam mounted across said weaving width of said frame on a longitudinal axis;

a spring biased tensioning element mounted on said beam for pivoting said axis under the bais of warp threads within said weaving width; and means rotatably supporting said beam intermediately of said weaving width of said frame.

2. The combination as set forth in claim 1 which further comprises a longitudinally elongated step bearing extending over said weaving width of said frame and supporting said tensioning element thereon, said bearing being supported on said support beam.

3. The combination as set forth in claim 1 which further comprises a plurality of longitudinally spaced step bearings supported on said support beam and disposed across said weaving width of said frame to support said tensioning element.

4. The combination as set forth in claim 1 wherein said means includes a plurality of step bearings supporting said support beam.

5. The combination as set forth in claim 4 wherein said step bearings are mounted on said frame.

6. The combination as set forth in claim 1 wherein said support beam is hollow and is freely rotatably mounted on said frame and which further comprises a torsion spring rod extending within said hollow support beam, said torsion spring rod being connected at one end to said hollow support beam and at an opposite end to said frame to permit spring biased rotation of said beam with said tensioning element thereon under the bias of warp threads on said tensioning element.

7. The combination as set forth in claim 6 wherein said rod includes a plurality of coaxially aligned sections and a plurality of couplings securing said sections together.

8. The combination as set forth in claim 6 wherein said rod is of polygonal cross-section.

9. The combination as set forth in claim 1 which further comprises a tensioning device mounted on said frame and connected to said beam for turning said beam and said tensioning element against the bias of warp threads on said tensioning element.

10. The combination as set forth in claim 1 which further comprises a drive motor for driving a warp beam mounted on said frame and a warp release control device having means for sensing a given position of said tensioning element and emitting a signal to said drive motor in response to said tensioning element occupying said position to regulate the speed of said motor.

11. The combination as set forth in claim 1 wherein said support beam and said tensioning element are made in one-piece.

12. The combination as set forth in claim 1 wherein said support beam includes a longitudinally disposed projection and said tensioning element is an arcuately bent strip secured to said projection across said weaving width of said face.

* * * * *